US009327503B2

(12) United States Patent
Higuchi

(10) Patent No.: US 9,327,503 B2
(45) Date of Patent: May 3, 2016

(54) LIQUID ABSORBER, LIQUID TANK, LIQUID DROPLET EJECTION DEVICE, AND SOUND ABSORBER

(71) Applicant: SEIKO EPSON CORPORATION, Tokyo (JP)

(72) Inventor: Naotaka Higuchi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,050

(22) Filed: Mar. 24, 2014

(65) Prior Publication Data

US 2014/0292913 A1 Oct. 2, 2014

(30) Foreign Application Priority Data

Mar. 27, 2013 (JP) ..... 2013-065791

(51) Int. Cl.
*B41J 2/165* (2006.01)
*B41J 2/17* (2006.01)

(52) U.S. Cl.
CPC ..... *B41J 2/16505* (2013.01); *B41J 2/16526* (2013.01); *B41J 2002/1742* (2013.01)

(58) Field of Classification Search
None
See application file for complete search history.

(56) References Cited

U.S. PATENT DOCUMENTS

2012/0069086 A1 3/2012 Tanaka
2012/0321839 A1* 12/2012 Uematsu et al. ..... 428/113

FOREIGN PATENT DOCUMENTS

| | | | |
|---|---|---|---|
| JP | 10-296999 | A | 11/1998 |
| JP | 2000-290865 | A | 10/2000 |
| JP | 2006-021451 | A | 1/2006 |
| JP | 2012-086551 | A | 5/2012 |
| JP | 2012-091408 | A | 5/2012 |

* cited by examiner

*Primary Examiner* — Justin Seo
(74) *Attorney, Agent, or Firm* — Global IP Counselors, LLP

(57) ABSTRACT

A liquid absorber that is constituted mainly by fibers, includes fusion bondable resin, and is configured to absorb liquid, includes a first surface having a largest surface area, and a second surface perpendicular to the first surface. The second surface includes a surface low in degree of fusion bond of the fusion bondable resin and a surface high in degree of fusion bond of the fusion bondable resin that has a higher degree of fusion bond of the fusion bondable resin than the surface low in degree of fusion bond, and at least a part of the surface low in degree of fusion bond absorbs the liquid.

7 Claims, 6 Drawing Sheets

LIQUID ABSORBER, LIQUID TANK, LIQUID DROPLET EJECTION DEVICE, AND SOUND ABSORBER

CROSS-REFERENCE TO RELATED APPLICATIONS

This application claims priority to Japanese Patent Application No. 2013-065791 filed on Mar. 27, 2013. The entire disclosure of Japanese Patent Application No. 2013-065791 is hereby incorporated herein by reference.

BACKGROUND

1. Technical Field

The present invention relates to a liquid absorber, a liquid tank, a liquid droplet ejection device, and a sound absorber.

2. Related Art

As a liquid tank for collecting ink to be discharged, a structure is known in which a plurality of ink absorbing materials are arranged in a stacked manner in a tank main body (see, e.g., Japanese Unexamined Laid-open Patent Application Publication No. 2012-86551).

Such an ink absorbing material is formed by cutting a large sheet into a predetermined size. As a cutting method, for example, when cutting with heat cutting, etc., the degree of fusion bond at the end surface (cut plane) of the ink absorbing material increases, which can control occurrence of scuffing of fibers. However, there is a problem that the permeability of the ink from the cut plane deteriorates.

SUMMARY

The present invention was made to solve at least a part of the aforementioned problems, and is capable of realizing as the following embodiments or applied examples.

A liquid absorber according to the applied example is constituted mainly by fibers, includes fusion bondable resin, and is configured to absorb liquid. The liquid absorber includes a first surface having a largest surface area, and a second surface perpendicular to the first surface. The second surface includes a surface low in degree of fusion bond of the fusion bondable resin and a surface higher in degree of fusion bond of the fusion bondable resin that has a higher degree of fusion bond of the fusion bondable resin than the surface low in degree of fusion bond, and at least a part of the surface low in degree of fusion bond absorbs the liquid.

According to this structure, since the surface low in degree of fusion bond of the second surface is used as a surface for absorbing the liquid, the liquid can easily permeate the liquid absorber. Further the surface high in degree of fusion bond of the second surface hardly permeates liquid, but is not used as a surface for absorbing liquid, which does not exert on the liquid absorption property. On the other hand, since the surface is higher in degree of fusion bond than the surface low in degree of fusion bond of the second surface, occurrence of scuffing of fibers can be controlled.

In the liquid absorber according to the aforementioned applied Example, the liquid absorber further includes a concave portion, and a surface of the concave portion is the surface low in degree of fusion bond.

With this structure, by receiving the liquid with the concave portion, the liquid hardly leaks to the other portions and the portion for receiving liquid can be specified.

According to the aforementioned applied Example, an outer peripheral surface of the liquid absorber is formed by the surface high in degree of fusion bond of the fusion bondable resin that the second surface includes, and the second surface includes the concave portion.

With this structure, since the outer peripheral surface having a larger surface area among the second surface is high in degree of fusion bond, it becomes possible to control occurrence of scuffing of fibers and permeate ink from the concave portion.

The concave portion of the liquid absorber according to the aforementioned applied Example is formed by cutting a part of an outer periphery of the liquid absorber.

Since it is structured by an outer peripheral surface and the concave portion in contact with the outer peripheral surface, it is easy to form surfaces different in degree of fusion bond by performing cuttings and/or heating treatments by different methods. For example, although it is difficult to change the degree of fusion bond between a part and the other parts of a continuous surface, by providing the concave portion, it becomes easy to change the degree of fusion bond.

The concave portion of the liquid absorber according to the aforementioned applied Example is positioned apart from the outer peripheral surface.

Since it is constructed to include the outer peripheral and the concave portion positioned apart from the outer peripheral surface, surfaces different in degree of fusion bond can be easily obtained by cutting or performing a heating treatment by different methods.

The liquid tank according to this applied Example includes the aforementioned liquid absorber and an accommodation portion configured to accommodate the liquid absorber.

According to this structure, by discharging liquid toward the surface low in degree of fusion bond, the permeability of liquid can be enhanced. Further, at the portion high in degree of fusion bond, occurrence of scuffing of fibers is controlled, and therefore dropping of fibers can be prevented when, e.g., accommodating the liquid absorber in the accommodation portion.

The liquid droplet ejection device according to this applied Example includes a head configured to eject liquid, and the aforementioned liquid tank configured to capture the liquid discharged from the head.

According to this structure, the liquid discharged from the head is captured by the liquid absorber accommodated in the liquid tank. The liquid absorber has a surface low in degree of fusion bond and is excellent in liquid permeability. Further, at the portion high in degree of fusion bond, since occurrence of scuffing of fibers is controlled, dropping of fibers in the device can be controlled.

The sound absorber according to this applied Example includes a surface low in degree of fusion bond and a surface high in degree of fusion bond. The sound absorber is configured to use in a state in which the surface low in degree of fusion bond faces a sound source.

According to this structure, since the surface low in degree of fusion bond faces the sound source, without causing reflection of sound, it is possible to introduce the sound into the sound absorber to be attenuated. Further, since the other surfaces are high in degree of fusion bond, occurrence of scuffing of fibers can be prevented.

BRIEF DESCRIPTION OF THE DRAWINGS

Referring now to the attached drawings which form a part of this original disclosure.

DETAILED DESCRIPTION OF EXEMPLARY EMBODIMENTS

Hereinafter, embodiments of the present invention will be explained with reference to figures. In each of the following figures, the scale of each member, etc., is shown so as to be different from the actual scale to make each member, etc., recognizable size.

First Embodiment

Figure 1A:
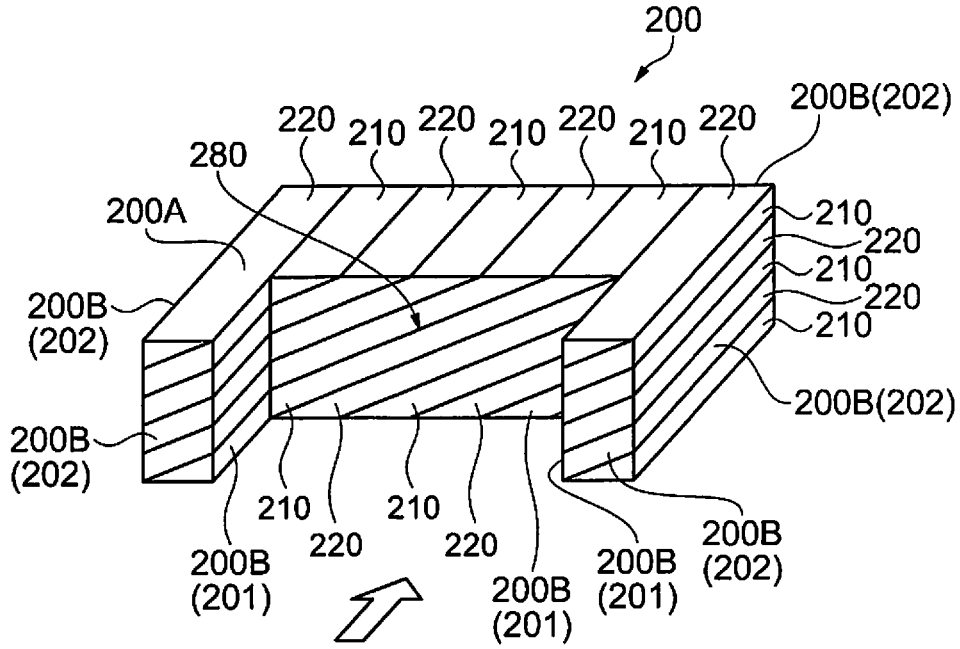
FIG. 1A is a schematic view showing a structure of a liquid absorber according to a first embodiment.

Initially, the structure of a liquid absorber will be explained. FIG. 1 is a schematic view showing the structure of the liquid absorber. The liquid absorber 200 of this embodiment is constituted by fibers as main components, includes fusion bondable resin, and absorbs liquid. As shown in FIG. 1A, the liquid absorber 200 includes a first surface 200A (entire upper surface in FIG. 1A) which has the largest surface area, and a second surface 200B perpendicular to the first surface, and the second surface 200B is provided with a surface 201 which is low in degree of fusion bond and a surface 202 which is higher in degree of fusion bond than the degree of fusion bond of the surface 201 low in degree of fusion bond. In such a structure, the liquid absorber is arranged so that at least a part of the surface 201 low in degree of fusion bond absorbs liquid. The perpendicular surface denotes a surface having an angle in the range of 90±15°. In this embodiment, a concave portion 280 is provided in the liquid absorber 200, and the surface of the concave portion 280 is the surface 201 low in degree of fusion bond. The second surface 200B is an outer peripheral surface of the liquid absorber 200 and has the concave portion 280. The concave portion 280 of this embodiment is a shape in which a part of the outer periphery of the liquid absorber 200 is cut. The concave portion 280 is constituted by three surfaces, and the three surfaces are surfaces 201 low in degree of fusion bond. At least a part of these three surfaces 201 low in degree of fusion bond absorbs liquid. In this disclosure, a degree of fusion bond denotes a degree of fusion bond of fusion bondable resin. Higher in degree of fusion bond, it becomes a state in which fusion bondable resin is fusion-bonded. In the surface 201 low in degree of fusion bond, as compared with the surface 202 high in degree of fusion bond, since the air gap between fibers and the fibers are exposed, the permeability of liquid is high. Accordingly, by impregnating liquid from the surface 201 low in degree of fusion bond, the liquid permeability efficiency can be improved. On the other hand, in the surface 202 high in degree of fusion bond, as compared with the surface 201 low in degree of fusion bond, fibers are more adhered with each other by the fusion bond of fusion bondable resin, etc., and therefore it becomes possible to prevent occurrence of scuffing of fibers.

Further, the liquid absorber 200 of this embodiment includes, in the side view (view point of the arrow direction in the figure) of the liquid absorber 200, a portion 220 low in density and a portion 210 higher in density as compared with the low-density portion 220, and the low-density portion (layer) 220 and the high-density portion (layer) 210 are stacked alternately obliquely and integrally formed. This oblique stack extends in a direction perpendicular to the surface where the oblique stack is visible. Further, "oblique" in the context of "oblique stack" means "oblique" with respect to the surface perpendicular to the surface where the oblique stack is visible. By stacking the low-density portions 220 and the high-density portion 210 obliquely in plural on one surface as mentioned above, on each surface perpendicular to the one surface of the liquid absorber 200, the low-density portion 220 and the high-density portion 210 can be brought into sight alternately and repeatedly.

Also on the surface 201 low in degree of fusion bond of the concave portion 280, the low-density portion 220 and the high-density portion 210 are brought into sight alternately and repeatedly. At the portion 220 low in density, it is possible to attain an easy (quick) absorption of liquid. Further, although the portion 210 high in density deteriorates in liquid permeability as compared with the portion 220 low in density, the high-density portion has a retention capacity for retaining absorbed liquid.

The width size, the number of stacks, etc., of the low-density portion 220 and the high-density portion 210 can be arbitrarily set. For example, in the surface of the liquid absorber 200 for receiving liquid, it is preferable to laminate the low-density portion 220 and the high-density portion 210 so that the stack width is smaller than the width of the liquid to be discharged. With this structure, since the liquid droplet comes into contact with both of the low-density portion 220 and the high-density portion 210, it becomes possible to assuredly absorb liquid from the low-density portion 220.

The liquid absorber 200 is a mixture containing cellulose fibers, fusion bondable resin, and fire-retardant, and the density of the low-density portion 220 and the high-density portion 210 is a density of the cellulose fibers, the fusion bondable resin, or the fire-retardant.

The cellulose fibers are formed by defibrating a pulp sheet, etc., using a dry defibrating machine, such as, e.g., a rotary crushing equipment, etc. The fusion bondable resin is used to perform a connection between cellulose fibers, secure an appropriate strength (hardness, etc.) of the liquid absorber 200, prevent lettering of paper powder/fibers, and contribute to a shape maintenance at the time of absorbing liquid. As the fusion bondable resin, various forms such as a fibrous form or a powder form can be employed. By heating the mixture in which cellulose fibers and fusion bondable resin are mixed, it becomes possible to melt the fusion bondable resin to fuse to the cellulose fibers and solidify them. The melting is preferably performed at a temperature of the degree of not causing heat deterioration of the cellulose fiber, etc. Further, the fusion bondable resin is preferably a fibrous form easily tangled with paper fibers in the defibrated member. Further, it is preferable to be a composite fiber of a core-clad structure. In the fusion bondable resin of a core-clad structure, the peripheral clad portion melts at low temperature and the core portion of the fibrous form is bonded to the fusion bondable resin itself or the cellulose fiber to attain a strong bonding.

The fire-retardant is added to give fire retardancy to the liquid absorber 200. As the fire-retardant, it is possible to use, for example, an inorganic material such as aluminum hydroxide, magnesium hydrate, etc., or a phosphorus organic material (for example, aromatic series ester phosphate such as triphenylphosphate).

Further, a resin layer can be formed on the first surface 200A of the liquid absorber 200. In this case, occurrence of scuffing of fibers on the first surface 200A can be prevented. In this case, as the resin, thermoplastic resin can be used.

As the thermoplastic resin, for example, polyvinyl acetate, polyvinyl alcohol, polyvinyl butyral, polystyrene ABS resin, polymethylmethacrylate (metacrylate resin), polyphenylene oxide (Noryl resin), polyurethane, ionomer resin (SURLYN A), cellulosic plastic, polyethylene, polypropylene, polyamide (nylon), polycarbonate, polyacetal (polyoxymethylene), polyphenylene sulfide, vinylidene chloride, polyethylene terephthalate, and fluorine resin (tetrafluoroethylene) can be applied.

As a method for forming the liquid absorber 200, for example, a mixture in which cellulose fibers, fusion bondable resin, and fire-retardant are mixed is screened to deposit on a mesh belt arranged blow the screen to form a deposit. At this time, the mesh belt is moved at a predetermined rate to cause a deposit so as to form a low-density portion 220 low in density and a high-density portion 210 high in density. Then, the formed deposit is subjected to a pressurizing and heating treatment. With this, the fusion bondable resin is molten, and the deposit is formed into a desired thickness. Further, it is punched out into a desired size to thereby form a liquid absorber 200. At the time of the punching, the concave portion 280 is cut by, for example, a Thomson cut, and the other portions are cut by heat cutting, etc. By cutting while applying heat, the surface 201 low in degree of fusion bond and the surface 202 high in degree of fusion bond can be formed relatively easily. Alternatively, by performing a heating treatment for applying heat after cutting, the surface 202 high in degree of fusion bond can be formed and it is also possible to make the surface to which no heat is applied into a surface low in degree of fusion bond. At the time of forming the liquid absorber 200, the pressurizing and heating treatment is performed from the side of the first surface 200A. For this reason, the degree of fusion bond of the first surface 200A becomes higher than the degree fusion of the inside of the liquid absorber 200. Further, the Thomson cut surface becomes to have almost the same degree of fusion bond as the degree of fusion bond of the inside of the liquid absorber 200. The heat cut surface or the heat treated surface becomes to have almost the same degree of fusion bond as the degree of fusion bond of the first surface 200A or becomes low in degree of fusion bond by the period of time during which heat was being applied.

Figure 1B:
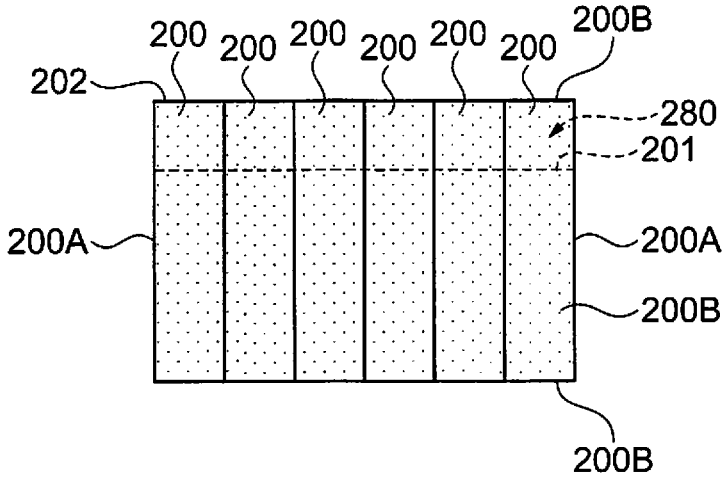
FIG. 1B is a schematic view showing the structure of the liquid absorber according to the first embodiment.

FIG. 1B shows a structure in which a plurality of liquid absorbers are stacked. As shown in FIG. 1B, a plurality of liquid absorbers 200 are stacked. In this embodiment, it shows a configuration in which 6 pieces of the liquid absorbers 200 are stacked. Further, the first surfaces A having the largest area among the surfaces constituting the liquid absorber 200 are in contact with each other. With this, the permeability of the liquid can be secured, and the absorption permissible amount of liquid can be increased. The structure of each liquid absorber 200 is the same as the structure shown in FIG. 1A, and therefore, the explanation will be omitted. Here, a resin layer can be formed on respective first surfaces 200A of the two liquid absorbers 200 which are located at the outermost sides. With this, it becomes possible to prevent occurrence of scuffing of fibers on the first surfaces 200A. The resin to be used for the resin layer is similar to the resin shown in FIG. 1A, thermoplastic resin, etc., can be used as the resin.

Figure 2:
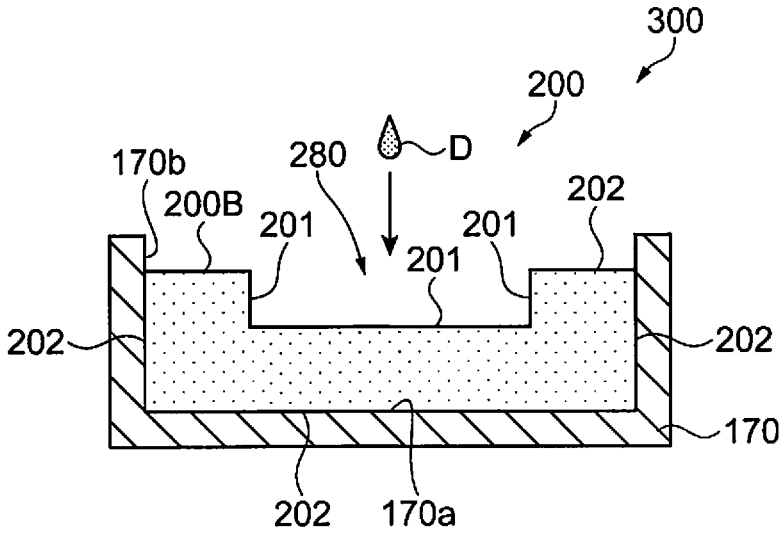
FIG. 2 is a cross-sectional view showing a structure of a liquid tank.

Next, the structure of the liquid tank will be explained. FIG. 2 is a cross-sectional view showing the structure of the liquid tank. As shown in FIG. 2, the liquid tank 300 is provided with a liquid absorber 200 for absorbing liquid and an accommodation portion 170 for accommodating the liquid absorber 200.

The accommodation portion 170 for accommodating the liquid absorber 200 is formed into, for example, a rectangular shape by plastic material. The accommodation portion 170 includes a bottom portion 170*a* and a side portion 170*b*, and is formed so as to be able to accommodate and retain the liquid absorber 200.

It is arranged such that the concave portion 280 of the liquid absorber 200 appears on the surface. Liquid is discharged to the position of the concave portion 280. Therefore, it is arranged such that the surface 201 low in degree of fusion bond appears on the surface and becomes a surface for absorbing liquid. On the other hand, the surfaces 202 high in degree of fusion bond are in contact with the bottom portion 170*a* of the accommodation portion 170 and the side portion 170*b* thereof. At this time, since the surfaces 202 high in degree of fusion bond are controlled in occurrence of scuffing of fibers, no dropping of fibers occurs, and therefore the liquid absorber 200 can be mounted smoothly in the accommodation portion 170.

As shown in FIG. 2, when the liquid droplet D is discharged toward the liquid absorber 200 and reaches the surface of the liquid absorber 200, the liquid droplet D comes into contact with the surface 201 low in degree of fusion bond of the liquid absorber 200. The liquid is absorbed efficiently from the surface 201 low in degree of fusion bond. The absorbed liquid is retained by the high-density portions 210 stacked alternately. In FIG. 2, the concave portion 280 is sufficiently larger than the liquid droplet D. For this reason, the liquid droplet D is absorbed from the bottom surface of the concave portion 280, and not absorbed from the side surfaces thereof. In other words, it is absorbed from a part of the surface 201 low in degree of fusion bond. This differs depending on the size of the concave portion 280, and there is a case in which liquid droplet is absorbed from the entire surface of the surfaces 201 low in degree of fusion bond.

Here, it should be noted that the concave portion is not always required. In FIG. 2, the concave portion 280 can be removed, and the surface facing upward can be constituted by a surface low in degree of fusion bond.

In the aforementioned liquid tank 300, it can be configured such that a plurality of liquid absorbers 200 are stacked. In this case, the liquid absorption permissible amount can be further increased. Further, in the aforementioned liquid tank 300, the first surface 200A having the largest surface area can be arranged horizontally. Also in this case, it is sufficient to discharge liquid to the position of the concave portion 280. Even in this case, it is possible to efficiently impregnate the liquid.

Next, the structure of the liquid droplet ejection device will be explained. The liquid droplet ejection device is provided with a head for ejecting ink, and a liquid tank for capturing the liquid discharged from the head. In the liquid droplet ejection device 10 of this embodiment, the structure equipped with the aforementioned liquid absorber 200 and the liquid tank 300 will be explained.

Figure 3:
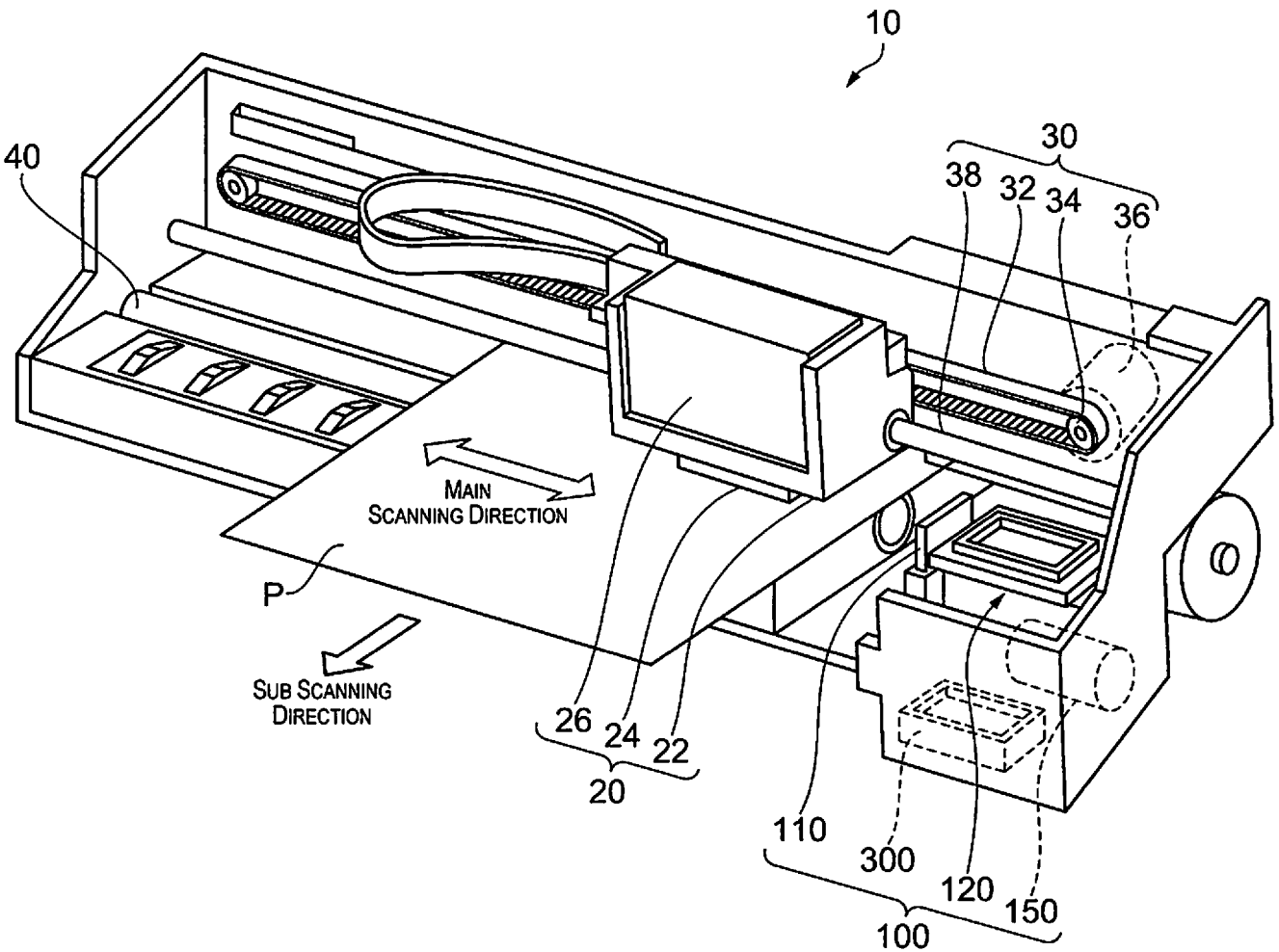
FIG. 3 is a schematic view showing the structure of the liquid droplet ejection device.

FIG. 3 is a schematic drawing showing a structure of a liquid droplet ejection device. As shown in FIG. 3, the liquid droplet ejection device 10 is constituted by a carriage 20 for forming ink dots on a print medium P such as a printing paper while reciprocally moving in the main scanning direction, a driving mechanism 30 for reciprocally moving the carriage 20, a platen roller 40 for performing paper feeding of the print medium P, a maintenance mechanism 100 for performing a maintenance so as to normally perform printing, etc. The carriage 20 is provided with an ink cartridge 26 for accommodating ink, a carriage case 22 for mounting the ink cartridge 26, a head 24 for ejecting ink mounted at the bottom surface side of the carriage case 22 (the side facing the print medium P), etc. This head 24 is provided with a plurality of nozzles for ejecting ink, and the ink in the ink cartridge 26 is introduced to the head 24 and ejected by an accurate amount to thereby print an image.

The driving mechanism 30 for reciprocally moving the carriage 20 is constituted by a guide rail 38 extending in the main scanning direction, a timing belt 32 having a plurality of teeth formed at the inside, a driving pulley 34 engaged with the teeth of the timing belt 32, a step motor 36 for driving the driving pulley 34, etc. A part of the timing belt 32 is fixed to the carriage case 22. By driving the timing belt 32, the carriage case 22 can be moved along the guide rail 38. Further, since the timing belt 32 and the driving pulley 34 are engaged with each other by teeth, by driving the driving pulley 34 by the step motor 36, the carriage case 22 can be moved accurately in accordance with the driving amount.

The platen roller 40 for performing paper feeding of the print medium P is driven by non-illustrated driving motor or gear mechanism, so that the print medium P can be fed in the sub-scanning direction by a predetermined amount.

The maintenance mechanism 100 is provided at a region called a home position located outside of the printing area, and includes a wiper blade 110 for wiping the surface (nozzle surface) on which the nozzle is formed at the bottom side of the head 24, a cap unit 120 for capping the head 24 by being pressed against the nozzle surface of the head 24, and a suction pump 150 for discharging ink as a liquid by being driven with the head 24 capped by the cap unit 120. By forcibly discharging the ink from the head 24 by a suction pump, the nozzle which became non-ejectable due to increased viscosity, destruction of meniscus, effects of paper powder, etc., is recovered, or the increase in ink viscosity in the nozzle is prevented. Further, below the suction pump 150, a liquid tank 300 for capturing the liquid discharged from the suction pump 150 is provided. By providing the liquid tank 300, the outer shape of the liquid droplet ejection device 10 increases. Since the ink permeability and/or retention capacity of the liquid absorber 200 is improved, the volume of the liquid absorber 200 capable of retaining the same amount of ink can be reduced. With this, the size of the liquid tank 300 and/or the liquid droplet ejection device 10 can be reduced. The liquid tank 300 has the same structure as that explained with reference to FIG. 2, and therefore the explanation will be omitted. The discharged liquid also includes ink which has not reached a medium, such as flushing ink ejected for the purpose of preventing the viscosity from being increased and the ink deviated from the medium when performing the so-called rimless printing, etc. Therefore, the discharged liquid is not always ink discharged from the suction pump 150. The liquid denotes ink which has discharged from the head 24 but not reached a medium.

According to this embodiment, the following effects can be obtained.

(1) The liquid absorber 200 has the concave portion 280, and the surface of the concave portion 280 is constituted by the surface 201 low in degree of fusion bond. Therefore, it becomes possible to easily impregnate liquid. Further, since another end surfaces of the liquid absorber 200 are surfaces 202 high in degree of fusion bond, occurrence of scuffing of fibers can be controlled.

(2) In the liquid tank 300 equipped with the aforementioned liquid absorber 200, liquid can be quickly absorbed. Further, a liquid tank 300 with no dropping of fibers can be provided.

(3) In the liquid droplet ejection device 10 equipped with the aforementioned liquid tank 300, the liquid discharged from the head 24 can be absorbed efficiently, and occurrence of scuffing of fibers in the device can be controlled.

First Example

Next, concrete examples according to the present invention will be explained.

1. Mixture

(1) Cellulose Fiber

A pulp sheet cut into several centimeters using a cutting machine was defibrated into a cotton form using a Turbo Mill (made of Turbo Corporation).

(2) Fusion Bondable Resin

It had a core-clad structure, and the clad was made of polyethylene which melts at a temperature of 100° C. or above, and the core was made of fusion bondable fiber (Tetoron, made by Teijin Corporation) made of polyester of 1.7 dtex.

(3) Fire-Retardant

Aluminum hydroxide B53 (made of Nippon Light Metal Company, Ltd.)

2. Post-Processing Resin

Fusion bondable resin: It had a core-clad structure in which the clad was made of polyethylene which melts at 100° C. or above and the core was made of a fusion bondable fiber made of polyester of 1.7 dtex (Tetoron, made of Teijin Corporation).

3. Formation of Liquid Absorber

Example 1

Formation of Liquid Absorber A

A mixture C1 in which 100 parts by weight of cellulose fibers, 15 parts by weight of fusion bondable fibers, and 10 parts by weight of fire-retardant were mixed in air, and a mixture C2 in which 100 parts by weight of cellulose fibers, 25 parts by weight of fusion bondable fibers, and 10 parts by weight of fire-retardant were mixed in air were deposited on a mesh belt alternately. At this time, the mixtures C1 and C2 were continuously deposited alternately while moving the mesh belt. The deposition can be performed while absorbing by a suction device. In Example 1, the mixture C1 and the mixture C2 were deposited alternately six times respectively. Then, the accumulated deposit was subjected to a pressurizing and heating treatment at 200° C. Thereafter, it was cut into 150 mm×50 mm×12 mm to form a liquid absorber A. In this liquid absorber A, an oblique stack in which a portion low in density (0.15 g/cm$^3$) and a portion high in density (0.17 g/cm$^3$) due to different of fusion bondable resin amount were stacked repeatedly was formed. When cutting into the liquid absorber A, the surface for absorbing liquid was cut by Thomson cutting. The other surfaces were cut by heat cutting.

Example 2

Formation of Liquid Absorber B

A mixture C1 in which 100 parts by weight of cellulose fibers, 15 parts by weight of fusion bondable fibers, and 10 parts by weight of fire-retardant were mixed in air, and a mixture C2 in which 100 parts by weight of cellulose fibers, 25 parts by weight of fusion bondable fibers, and 10 parts by weight of fire-retardant were mixed in air were deposited on a mesh belt alternately. At this time, the mixtures C1 and C2 were continuously deposited alternately while moving the mesh belt. The deposition can be performed while absorbing by a suction device. In Example 2, the mixture C1 and the mixture C2 were deposited alternately six times respectively. Then, the accumulated deposit was subjected to a pressurizing and heating treatment at 200° C. Thereafter, it was cut into 150 mm×50 mm×12 mm to form a liquid absorber B. In this liquid absorber B, an oblique stack in which a portion low in density (0.15 g/cm$^3$) and a portion high in density (0.17 g/cm$^3$) due to different of fusion bondable resin amount were stacked repeatedly was formed. When cutting into the liquid absorber B, the surface for absorbing liquid was cut by Thomson cutting. The other surfaces were cut by Thomson cutting and then the cut surface was subjected to a heating treatment.

Example 3

Formation of Liquid Absorber C

A mixture C1 in which 100 parts by weight of cellulose fibers, 15 parts by weight of fusion bondable fibers, and 10 parts by weight of fire-retardant were mixed in air was deposited on a mesh belt. The deposition can be performed while absorbing by a suction device. Then, the accumulated deposit was subjected to a pressurizing and heating treatment at 200° C. Thereafter, it was cut into 150 mm×50 mm×12 mm to form a liquid absorber C. In this liquid absorber C, the density was 0.15 g/cm$^3$. When cutting into the liquid absorber C, the surface for absorbing liquid was cut by Thomson cutting. The other surfaces were cut by Thomson cutting, then fusion bondable resin (resin for post processing) was applied to the cut surface, and thereafter the surface to which the fusion bondable resin was applied was subjected to a heating treatment.

Comparative Example 1

Formation of Liquid Absorber R1

A mixture C1 in which 100 parts by weight of cellulose fibers, 15 parts by weight of fusion bondable fibers, and 10 parts by weight of fire-retardant were mixed in air, and a mixture C2 in which 100 parts by weight of cellulose fibers, 25 parts by weight of fusion bondable fibers, and 10 parts by weight of fire-retardant were mixed in air were deposited on a mesh belt alternately. At this time, the mixtures C1 and C2 were continuously deposited alternately while moving the mesh belt. The deposition can be performed while absorbing by a suction device. In Comparative Example 1, the mixture C1 and the mixture C2 were deposited alternately six times respectively. Then, the accumulated deposit was subjected to a pressurizing and heating treatment at 200° C. Thereafter, it was cut into 150 mm×50 mm×12 mm to form a liquid absorber R1. In this liquid absorber R1, an oblique stack in which a portion low in density (0.15 g/cm$^3$) and a portion high in density (0.17 g/cm$^3$) due to different of fusion bondable resin amount were stacked repeatedly was formed. When cutting into the liquid absorber R1, either surface was cut by Thomson cutting.

Comparative Example 2

Formation of Liquid Absorber R2

A mixture C1 in which 100 parts by weight of cellulose fibers, 15 parts by weight of fusion bondable fibers, and 10 parts by weight of fire-retardant were mixed in air, and a mixture C2 in which 100 parts by weight of cellulose fibers, 25 parts by weight of fusion bondable fibers, and 10 parts by weight of fire-retardant were mixed in air were deposited on a mesh belt alternately. At this time, the mixtures C1 and C2 were continuously deposited alternately while moving the mesh belt. The deposition can be performed while absorbing by a suction device. In Comparative Example 2, the mixture C1 and the mixture C2 were deposited alternately six times respectively. Then, the accumulated deposit was subjected to a pressurizing and heating treatment at 200° C. Thereafter, it was cut into 150 mm×50 mm×12 mm to form a liquid absorber R2. In this liquid absorber R2, an oblique stack in which a portion low in density (0.15 g/cm$^3$) and a portion high in density (0.17 g/cm$^3$) due to different of fusion bondable resin amount were stacked repeatedly was formed. When cutting into the liquid absorber R2, either surface was cut by heat cutting.

4. Evaluation

Next, in the aforementioned Example 1 to Example 3 and Comparative Example 1 and Comparative Example 2, the ink permeability, the ink retention capacity, the deposition property and the presence or absence of occurrence of scuffing of fibers were evaluated. Each evaluation method was as follows.

(a) Evaluation Method of the Ink Permeability and the Ink Retention Capacity

Figure 4A:
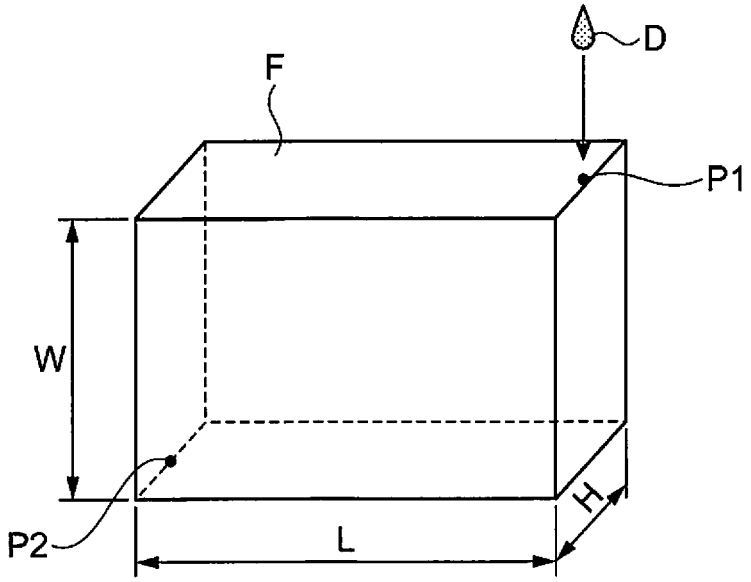
FIG. 4A is a schematic view showing an evaluation method of ink permeability and retention capacity of a liquid absorber.

FIG. 4 is a schematic diagram showing the evaluation method of the ink permeability and the ink retention capacity of the liquid absorber. As shown in FIG. 4A, the ink absorber F of 150 mm (L)×50 mm (W)×12 mm (H) was placed on a flat surface. At this time, it was arranged such that the surfaces having the largest surface area were arranged along a vertical direction with respect to the mounting surface. And ink of 80 ml was slowly injected from the first point P1 of the upper surface. When it was not permeated into the absorber F, it was left for 5 minutes, and then the injection was continued. If it was not permeated after leaving for 5 minutes, it was deemed that no ink was permeated, and the ink permeability was judged as NG. On the other hand, if all of them could be permeated, the ink permeability was judged as OK.

Figure 4B:
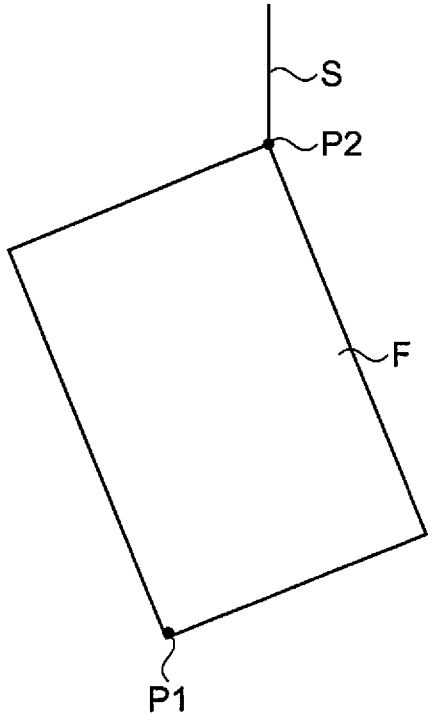
FIG. 4B is a schematic view showing the evaluation method of the ink permeability and the retention capacity of the liquid absorber.

When all ink could be permeated, it was left for 5 minutes, and as shown in FIG. 4B, the liquid absorber was suspended from the second point P2 using a strap S, etc., with the first point P1 from which the ink was introduced arranged below. In this suspended state, the permeated ink gathers at one end portion of the ink absorber F and is hard to be retained. When the ink was dripped off from the ink absorber F, it was deemed that ink could not be retained, and the ink retention capacity was judged as NG. On the other hand, when no ink was dripped off, the ink retention capacity was judged as OK. When the judgment of the ink permeability was NG, since a desired amount could not be absorbed, no judgment of the ink retention capacity was performed. With this evaluation, whether or not the ink was leaked when the liquid droplet ejection device and/or the liquid tank was arranged obliquely could be known.

(b) Evaluation Method of Ink Deposition Property

An ink absorber F of 150 mm (L)×50 mm (W)×12 mm (H) was placed on a flat surface. At this time, it is placed so that the surface having the largest surface area extended in the vertical direction with respect to the placed surface. Under the environment of 20% RH at 40° C., ink was dropped by 0.4 g at a time every hour on a central portion on the upper surface of the placed absorber F. After passing 240 hours, if the thickness of the solid deposit on the surface of the ink absorber F was less than 1 mm, the ink deposition property was judged as OK. On the other hand, if the thickness of the deposit was 1 mm or more, the ink deposition property was judged as NG.

(c) Evaluation Method of Present or Absence of Occurrence of Scuffing of Fibers

By a visual inspection of the liquid absorber F, it was inspected whether or not scuffing of fibers occurred. When there existed no scuffing of fibers, it was judged as OK and when there existed scuffing of fibers, it was judged as NG.

The evaluation results are shown in Table 1. Each evaluation result is shown as ◎: Excellent, ○: Good, ×: No good

TABLE 1

| | Ink Permeability | Ink Retention Capacity | Ink Deposition Property | Scuffing of Fibers |
|---|---|---|---|---|
| Example 1 | ○ | ○ | ○ | ○ |
| Example 2 | ○ | ○ | ○ | ○ |
| Example 3 | ○ | ◎ | ○ | ◎ |
| Comparative Example 1 | ○ | ○ | ○ | X |
| Comparative Example 2 | X | ○ | X | ○ |

As shown in Table 1, in the liquid absorbers A, B and C (Examples 1, 2, and 3) according to the present invention, satisfactory results were obtained on the ink permeability, the ink retention capacity, and the deposition property, and further the evaluation on the presence or absence of scuffing of fibers. On the other hand, in the liquid absorber R1 of Comparative Example 1, no satisfactory results could be obtained on the evaluation of occurrence of scuffing of fibers. In Comparative Example 1, all end portions were cut by Thomson cutting, and therefore the cut planes became surfaces low in degree of fusion bond. For this reason, scuffing of fibers occurred. Further, in the liquid absorber R2 of Comparative Example 2, no satisfactory results could be obtained on the ink permeability and the deposition property. In Comparative Example 2, all end portions were cut by heat cutting, and therefore the cut planes became surfaces high in degree of fusion bond. For this reason, although occurrence of scuffing of fibers can be controlled, the performance of ink permeation deteriorated. Since ink hardly permeates, deposits are generated.

Second Embodiment

Next, second embodiment will be explained.

Figure 5A:
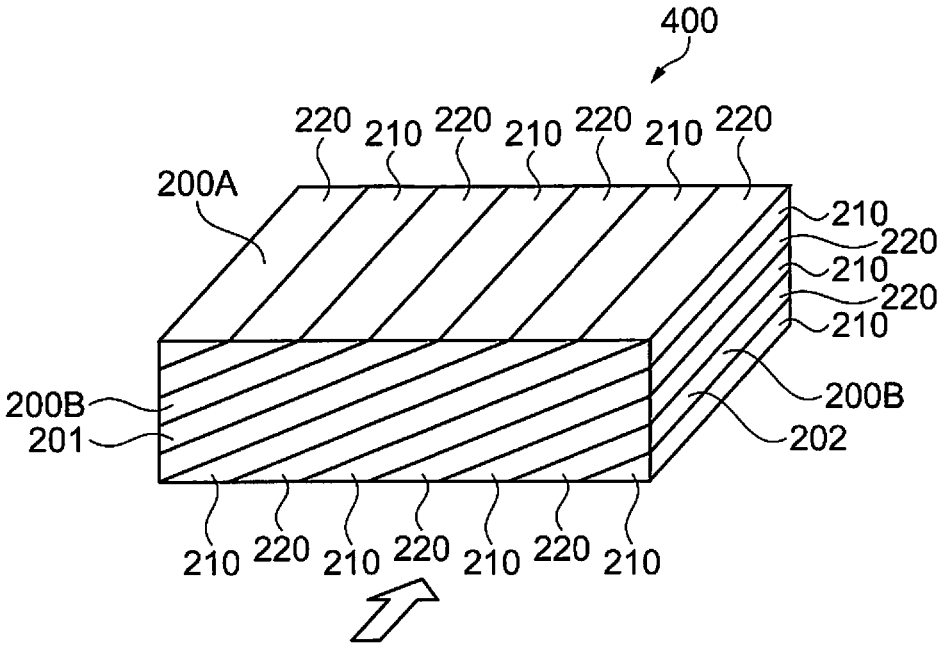
FIG. 5A is a schematic view showing a structure of a sound absorber according to a second embodiment.

Initially, the structure of a sound absorber will be explained. FIG. 5 is a schematic view showing a structure of a sound absorber according to this embodiment. The sound absorber 400 of this embodiment is constituted mainly by fibers, includes fusion bondable resin, and is configured to absorb sound noise (absorb sound) in, e.g., electronic devices. As shown in FIG. 5A, the sound absorber 400 includes a first surface 200A (entire upper surface in FIG. 5A) which is the largest surface area and a second surface 200B perpendicular to the first surface. The second surface 200B is provided with a surface 201 low in degree of fusion bond and a surface 202 high in degree of fusion bond. In such a structure, it is used with the surface 201 low in degree of fusion bond facing a sound source. In the surface low in degree of fusion bond, as compared with the surface high in degree of fusion bond, since air gaps between fibers are exposed, a sound can be easily introduced. The perpendicular surface denotes a surface having an angle in the range of 90±15°. Since the surface 201 low in degree of fusion bond faces a sound surface, a sound travels into the sound absorber 400 without being reflected and is attenuated, which can exerts sound absorbing effects. Further, in the surface 202 high in degree of fusion bond, as compared with the surface 201 low in degree of fusion bond, fibers are bonded more strongly by fusion of resin, etc., contained in fibers, and therefore occurrence of scuffing of fibers can be prevented.

Further, the sound absorber 400 of this embodiment includes, in the side view (in the arrow direction in the drawing) of the sound absorber 400, a portion 220 low in density and a portion 210 higher in density as compared with the low-density portion 220, and the low-density portion (layer) 220 and the high-density portion (layer) 210 are obliquely stacked alternately. This oblique stack extends in a direction perpendicular to the surface on which the oblique stack is visible. "Oblique" in the context of the oblique stack denotes "oblique" with respect to the surface perpendicular to the surface on which the oblique stack is visible. By stacking the low-density portion 220 and the high-density portion 210 obliquely on one surface, in each surface of the sound absorber 400 perpendicular to the one surface, the low-density portion 220 and the high-density portion 210 can be appeared alternately and repeatedly.

The width size, the number of stacks, etc., of the low-density portion 220 and the high-density portion 210 can be arbitrarily set.

The sound absorber 400 is a mixture containing cellulose fibers, fusion bondable resin, and fire-retardant, and the density of the low-density portion 220 and the high-density portion 210 denotes a density of the cellulose fibers, the fusion bondable resin or the fire-retardant.

A cellulose fiber is a fiber obtained by defibrating a pulp sheet, etc., using a dry defibrating machine, such as, example, a rotary crushing equipment, etc. Fusion bondable resin enhances bonding between cellulose fibers to thereby provide an appropriate strength (hardness, etc.) to the sound absorber 400, prevent scattering of paper powder/fibers, or contribute to configuration maintenance of the sound absorber. Fusion bondable resin can be in various forms such as a fibrous form or a powder form. By heating the mixture of cellulose fibers and fusion bondable resin, the fusion bondable resin can be molten and fusion bonded and solidified to the cellulose fibers. The fusion bonding is preferably performed at a temperature of the degree of not causing heat deterioration of the cellulose fiber, etc. Further, the fusion bondable resin is preferably a fibrous form easily tangled with cellulose fibers in the defibrated member. Further, it is preferable to be a composite fiber of a core-clad structure. In the fusion bondable resin of a core-clad structure, the peripheral clad portion melts at low temperature and the core portion of the fibrous form is bonded to the fusion bondable resin itself or the cellulose fiber to attain a strong bonding.

The fire-retardant is added to give fire retardancy to the sound absorber 400. As the fire-retardant, for example, inorganic materials such as aluminum hydroxide, magnesium hydrate, etc., or phosphorus organic material (for example, aromatic series ester phosphate such as triphenylphosphate) can be used.

On the first surface 200A of the sound absorber 400, a resin layer can be formed. With this, occurrence of scuffing of fibers of the first surface 200A can be prevented. In this case, as the resin, thermoplastic resin or thermosetting resin can be used.

As the thermoplastic resin, for example, polyvinyl acetate resin, polyvinyl alcohol, polyvinyl butyral, polystyrene ABS resin, polymethylmethacrylate (metacrylate resin), polyphenylene oxide (Noryl resin), polyurethane, ionomer resin (SURLYN A), cellulosic plastic, polyethylene, polypropylene, polyamide (nylon), polycarbonate, polyacetal (polyoxymethylene), polyphenylene sulfide, vinylidene chloride, polyethylene terephthalate, and fluorine resin (tetrafluoroethylene) can be applied.

Further, as the thermosetting resin, for example, phenol resin, urea resin, melamine resin, unsaturated polyester resins, diallyl phthalate resin, epoxy resin, silicon resin, alkyd resin, polyimide, polyamidebismaleimide, casein resin, fran resin, and urethane resin can be applied. Other than the above, ultraviolet curing resin or water hardening resin can also be used.

As a method for forming the sound absorber 400, for example, a mixture in which cellulose fibers, fusion bondable resin, and fire-retardant are mixed is screened to deposit on a mesh belt arranged blow the screen to form a deposit. At this time, the mesh belt is moved at a predetermined rate to cause a deposit so as to form a low-density portion 220 low in density of the mixture and a high-density portion 210 high in density of the mixture. Then, the formed deposit is subjected to a pressurizing and heating treatment. With this, the fusion bondable resin is molten, and the deposit is formed into a desired thickness. Further, it is punched out into a desired size to thereby form the sound absorber 400. End portion corresponding to the surface 201 small in degree of fusion bond is cut by, for example, Thomson cutting, and the other portions are cut by heat cutting, etc. By cutting while applying heat, the surface 201 low in degree of fusion bond and the surface 202 high in degree of fusion bond can be formed relatively easily. Alternatively, by performing a heating treatment for applying heat after cutting, the surface 202 high in degree of fusion bond can be formed and it is also possible to make the surface to which no heat is applied into a surface low in degree of fusion bond.

In the sound absorber 400 formed as mentioned above, the surface 201 low in degree of fusion bond and the surface 202 high in degree of fusion bond are formed. By facing the surface 201 low in degree of fusion bond toward the sound source, the sound can travel into the sound absorber 400 from the surface 201 low in degree of fusion bond without being reflected by the surface of the absorber 400. With this, the sound can be attenuated and therefore the sound absorbing effect can be enhanced. On the surface 202 high in degree of fusion bond, occurrence of scuffing of fibers can be controlled.

Figure 5B:
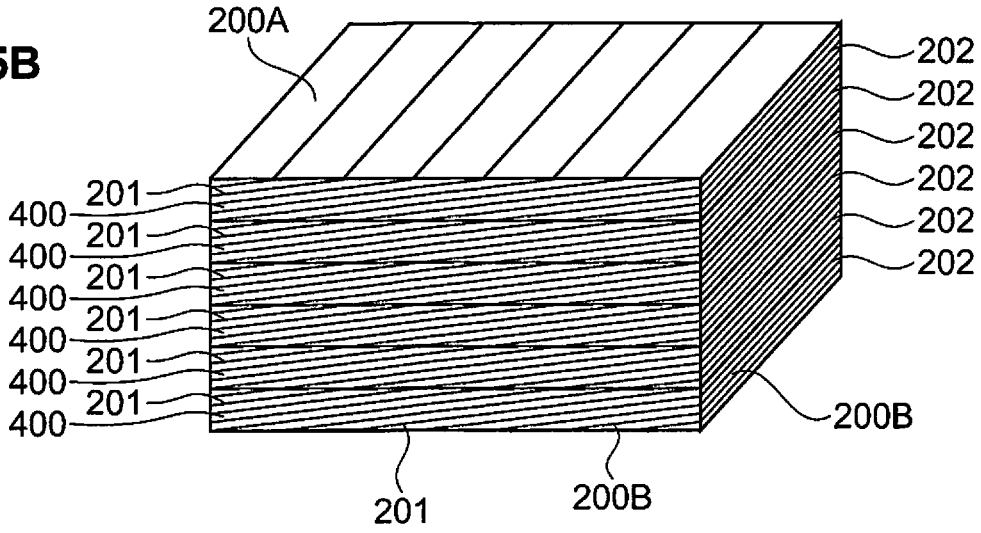
FIG. 5B is a schematic view showing the structure of the sound absorber according to the second embodiment.

FIG. 5B shows a structure in which a plurality of sound absorbers 400 are stacked. As shown in FIG. 5B, six sound absorbers 400 are stacked. Further, the first surfaces 200A which are the largest surface areas among the surfaces constituting the sound absorber 400 are in contact with each other. A plurality of sound absorbers 400 are stacked so that the surfaces 201 low in degree of fusion bond align at one surface side. With this, the area of the surface 201 low in degree of fusion bond is increased, which further enhances the sound absorbing effect.

Figure 6:
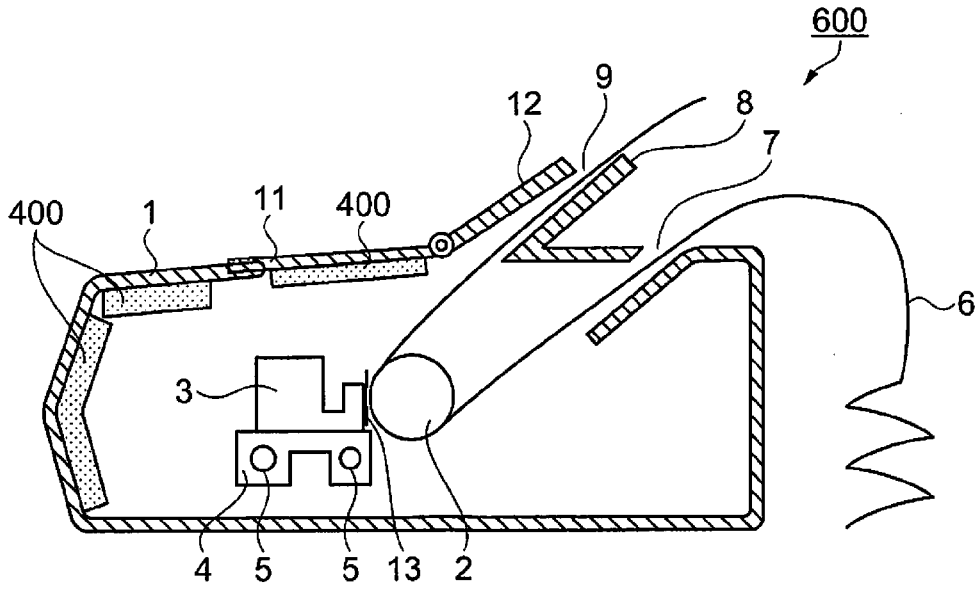
FIG. 6 is a cross-sectional view showing a structure of a printer.

Next, a structure of an electronic device will be explained. In this embodiment, a structure of a printer as an electronic device will be explained. FIG. 6 is a cross-sectional view showing the structure of the printer. As shown in FIG. 6, the printer 600 according to this embodiment is configured to perform printing by giving an impact force to a printing paper 6 as a print media arranged between a platen 2 and a print head 3 by print wires (not shown) provided in the print head 3 via an ink ribbon 13.

The printing paper 6 is fed from the paper feeding port 7 formed in a case member 1 for the printer 600, wound on the platen 2, subjected to printing (printing is a wide concept including printing of graphs by dots, etc., as well as numerals, characters, etc.), and then discharged from the paper discharging port 9. A carriage 4 is guided by guide shafts 5 and movable in a guide shaft direction. An ink ribbon 13 is arranged between the print head 3 and the printing paper 6, and the print head 3 fixed to the carriage 4 performs printing at a desired timing while moving in the guide shaft direction by driving a plurality of print wires provided in the print head 3.

An openable and closable cover 11 and a paper discharging port cover 12 are provided at the case member 1, and the paper discharging port cover 12 is rotatably connected to the cover 11. When the paper discharging port cover 12 is constituted by a transparent and lightweight member, the printing paper 6 can be easily recognized and taken out. A printed printing paper 6 is discharged from the paper discharging port 9 along the paper guide 8.

Further, the printer 600 is provided with sound absorbers 400 for absorbing sound noise. The structure of the sound absorber 400 is the same as the structure shown in FIG. 1, and therefore the explanation will be omitted. In this embodiment, at portions of the case member 1 corresponding to the periphery of the print head 3, sound absorbers 400 are arranged. Concretely, the sound absorbers are arranged at portions corresponding to the opposite side of the driving portion of the print head 3 of the case member 1. The sound absorber 400 is arranged so that a sound source and the surface 201 low in degree of fusion bond are opposed each other. Further, it is preferable to provide the sound absorber 400 in the form of plural stack (FIG. 5B). The sound absorber 400 is arranged also at the cover 11 above the print head 3. With this, when sound noise is generated by the driving of the print head 3, the generated sound is introduced from the surface 201 low in degree of fusion bond of the sound absorber 400 and the reflected sound is transferred through the low-density portion 220 while being reflected by the high-density portion 210. In this process, sound can be effectively absorbed to prevent diffusion of sound noise in the case member 1.

In this embodiment, although the explanation was made by exemplifying a printer as an electronic device, but the present invention is not limited to it, and can be applied to various electronic devices.

According to this embodiment, the following effects can be obtained.

(1) The sound absorber 400 has the surface 201 low in degree of fusion bond and the surface 202 high in degree of fusion bond. By facing the surface 201 low in degree of fusion bond toward the sound source, sound can be introduced into the sound absorber 400 to be absorbed. Further, since the other end surfaces of the sound absorber 400 are surfaces 202 high in degree of fusion bond, occurrence of scuffing of fibers can be controlled.

(2) In the printer 600 equipped with the aforementioned sound absorber 400, sound noise generated at the time of driving the print head 3 can be effectively absorbed. Further, occurrence of dropping of fibers in the printer 600 can be prevented.

Second Example

Next, a concrete example according to the present invention will be explained.

1. Mixture (1) Cellulose Fiber

A pulp sheet cut into several centimeters using a cutting machine was defibrated into a cotton form using a Turbo Mill (made of Turbo Corporation).

(2) Fusion Bondable Resin

It had a core-clad structure, and the clad was made of polyethylene which melts at a temperature of 100° C. or above, and the core was made of fusion bondable fiber (Tetoron, made by Teijin Corporation) made of polyester of 1.7 dtex.

(3) Fire-Retardant

Aluminum hydroxide B53 (made of Nippon Light Metal Company, Ltd.)

2. Formation of Sound Absorber

Example 1

Formation of Sound Absorber A

A mixture C1 in which 100 parts by weight of cellulose fibers, 15 parts by weight of fusion bondable fibers, and 10 parts by weight of fire-retardant were mixed in air, and a mixture C2 in which 100 parts by weight of cellulose fibers, 25 parts by weight of fusion bondable fibers, and 10 parts by weight of fire-retardant were mixed in air were deposited on a mesh belt alternately. At this time, the mixtures C1 and C2 were continuously deposited alternately while moving the mesh belt. The deposition can be performed while absorbing by a suction device. In Example 1, the mixture C1 and the mixture C2 were deposited alternately six times respectively. Then, the accumulated deposit was subjected to a pressurizing and heating treatment at 200° C. Thereafter, it was cut into ϕ29 mm×thickness 10 mm to form a sound absorber A. In this sound absorber A, an oblique stack in which a portion low in density (0.15 g/cm$^3$) and a portion high in density (0.17 g/cm$^3$) due to different of fusion bondable resin amount were stacked repeatedly was formed. When cutting into the sound absorber A, the surface for absorbing sound was cut by Thomson cutting. The other surfaces were cut by heat cutting.

Example 2

Formation of Sound Absorber B

A mixture C1 in which 100 parts by weight of cellulose fibers, 15 parts by weight of fusion bondable fibers, and 10 parts by weight of fire-retardant were mixed in air, and a mixture C2 in which 100 parts by weight of cellulose fibers, 25 parts by weight of fusion bondable fibers, and 10 parts by weight of fire-retardant were mixed in air were deposited on a mesh belt alternately. At this time, the mixtures C1 and C2 were continuously deposited alternately while moving the mesh belt. The deposition can be performed while absorbing by a suction device. In Example 2, the mixture C1 and the mixture C2 were deposited alternately six times respectively. Then, the accumulated deposit was subjected to a pressurizing and heating treatment at 200° C. Thereafter, it was cut into ϕ29 mm×thickness 10 mm to form a sound absorber B. In this sound absorber B, an oblique stack in which a portion low in density (0.15 g/cm$^3$) and a portion high in density (0.17 g/cm$^3$) due to different of fusion bondable resin amount were stacked repeatedly was formed. When cutting into the sound absorber B, the surface for absorbing liquid was cut by Thomson cutting. The other surfaces were cut by Thomson cutting and then the cut surface was subjected to a heating treatment.

Comparative Example 1

Formation of Sound Absorber R1

A mixture C1 in which 100 parts by weight of cellulose fibers, 15 parts by weight of fusion bondable fibers, and 10 parts by weight of fire-retardant were mixed in air, and a mixture C2 in which 100 parts by weight of cellulose fibers, 25 parts by weight of fusion bondable fibers, and 10 parts by weight of fire-retardant were mixed in air were deposited on a mesh belt alternately. At this time, the mixtures C1 and C2 were continuously deposited alternately while moving the mesh belt. The deposition can be performed while absorbing by a suction device. In Comparative Example 1, the mixture C1 and the mixture C2 were deposited alternately six times respectively. Then, the accumulated deposit was subjected to a pressurizing and heating treatment at 200° C. Thereafter, it was cut into 150 mm×50 mm×12 mm to form a sound absorber R1. In this sound absorber R1, an oblique stack in which a portion low in density (0.15 g/cm$^3$) and a portion high in density (0.17 g/cm$^3$) due to different of fusion bondable resin amount were stacked repeatedly was formed. When cutting into the sound absorber R1, either surface was cut by Thomson cutting.

Comparative Example 2

Formation of Sound Absorber R2

A mixture C1 in which 100 parts by weight of cellulose fibers, 15 parts by weight of fusion bondable fibers, and 10 parts by weight of fire-retardant were mixed in air, and a mixture C2 in which 100 parts by weight of cellulose fibers, 25 parts by weight of fusion bondable fibers, and 10 parts by weight of fire-retardant were mixed in air were deposited on a mesh belt alternately. At this time, the mixtures C1 and C2 were continuously deposited alternately while moving the mesh belt. The deposition can be performed while absorbing by a suction device. In Comparative Example 2, the mixture C1 and the mixture C2 were deposited alternately six times respectively. Then, the accumulated deposit was subjected to a pressurizing and heating treatment at 200° C. Thereafter, it was cut into ϕ29 mm×thickness 10 mm to form a sound absorber R2. In this sound absorber R2, an oblique stack in which a portion low in density (0.15 g/cm$^3$) and a portion high in density (0.17 g/cm$^3$) due to different of fusion bondable resin amount were stacked repeatedly was formed. When cutting into the liquid absorber R2, either surface was cut by heat cutting.

3. Evaluation

Next, for the aforementioned Example 1, Example 2, and Comparative Example 1, and Comparative Example 2, sound absorbency and presence or absence of occurrence of scuffing of fibers were evaluated. The evaluation of the sound absorbency was performed by measuring sound absorption coefficient (normal incident sound absorption coefficient) based on JIS A 1405-2. Concretely, the evaluation was performed as follows.

(a) Evaluation Method of Sound Absorbency

Figure 7:
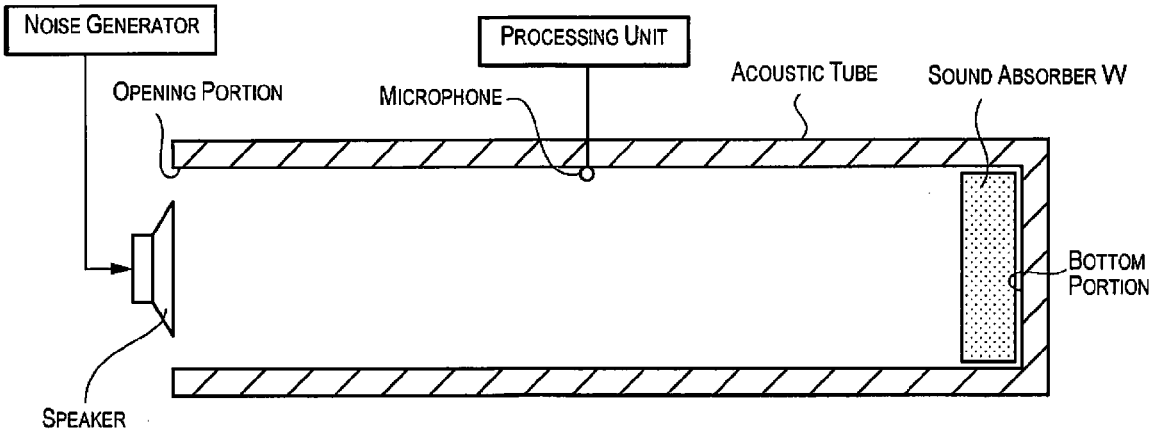
FIG. 7 is a schematic view showing an evaluation method of sound absorbency.

FIG. 7 is a schematic view showing an evaluation method of sound absorbency. As shown in FIG. 7, the equipment for evaluation the sound absorbency is provided with an acoustic tube, a bottom portion provided at one end portion of the acoustic tube, an opening opened at the other end portion of the acoustic tube, a microphone arranged inside of the acoustic tube, a speaker arranged at the opening portion of the acoustic tube, a noise generator connected to the speaker, a processing unit, etc.

After setting the sound absorber W at the bottom portion of the acoustic tube, sound of a predetermined frequency was emitted from the speaker to create an acoustic field in the acoustic tube. Then, based on the sound pressure signal obtained from the microphone in the acoustic tube, normal incident sound absorption coefficient was calculated. By this evaluation, the sound absorbency of the sound absorber W could be evaluated. In Example 1 and Example 2, the sound absorbers A and B were set so that the surface cut by Thomson cutting faces the speaker.

(b) Evaluation Method of Present or Absence of Occurrence of Scuffing of Fibers

By a visual inspection of the sound absorber, it was inspected whether or not scuffing of fibers occurred. When there existed no scuffing, it was judged as OK and when there existed scuffing, it was judged as NG.

The evaluation results are shown in Table 2. Each evaluation result is shown as ◎: Excellent, ○: Good, ×: No good

TABLE 2

| | Sound Absorbency | Scuffing of Fibers |
|---|---|---|
| Example 1 | ○ | ○ |
| Example 2 | ○ | ○ |
| Comparative Example 1 | ○ | X |
| Comparative Example 2 | X | ○ |

As shown in Table 2, in Example 1 and Example 2, satisfactory results were obtained on the evaluation of the sound absorbency and the scuffing of fibers. On the other hand, in the sound absorber R1 of Comparative Example 1, no satisfactory results were obtained on the evaluation of occurrence of scuffing of fibers. This was because all end portions were cut by Thomson cutting in Comparative Example 1, and the cut plane became a surface low in degree of fusion bond. This caused scuffing of fibers. Further, in the sound absorber R2 of Comparative Example 2, no satisfactory results were obtained on the sound absorbancy. This was because all end portions were cut by heat cutting in Comparative Example 2, and a surface high in degree of fusion bond faces the sound source. Therefore, although occurrence of scuffing of fibers could be controlled, sound is easily reflected by the surface high in degree of fusion bond, resulting in deterioration of sound absorbing effect.

In some cases, there is a case in which the surface low in degree of fusion bond and the surface high in degree of fusion bond, which is a feature of this application, can be recognized as an appearance with eyes. Concretely, it can be judged that the surface low in flatness is a surface high in degree of fusion bond, and the surface high in flatness is a surface low in degree of fusion bond. Further, as compared with the surface low in degree of fusion bond, the surface high in degree in fusion is hardly tore off.

There is a case in which the oblique stack of the low-density portion and the high-density portion, which is a feature of the present application, can be recognized as an appearance with eyes, but there is a case in which it cannot be recognized when the density difference thereof is slight. As a method of verification in that case, by tearing off the absorber after impregnating water or ink, the layer direction can be recognized. Further when ink is dropped, if there exists a layer in which the ink easily permeates obliquely, the layer can be recognized as a stack oblique in degree of density. If the entire liquid absorber is uniform in density, when ink is dropped, the ink permeates approximately evenly right and left while permeating by gravity in the downward direction. Further, in the case of layers in which a high-density layer and a low-density layer are arranged horizontally, there is a layer which easily impregnates right and left.

The aforementioned Examples are employed as a liquid tank 300 and a liquid absorber 200 for use in a liquid droplet ejection device 10. Here, ink includes various kinds of liquid compositions, such as, common aqueous ink, oil ink, pigment ink, dye ink, solvent ink, resin ink, sublimation transfer ink, gel ink, hot melt ink, ultraviolet cure ink, etc. Further, ink can be any materials that a head 24 can eject. For example, it is enough that the material is in a liquid phase state, and ink includes not only liquid crystal, a liquid state material high or low in viscosity, zol, gel liquid, fluid material such as inorganic solvent, organic solvent, solution, liquid resin, liquid metal (metal molten solution), liquid as one condition of a material, but also a material in which functional material particles of solid materials such as pigments or metal particles are dissolved, dispersed or mixed in a solvent, etching liquid, lubricating oil.

Further, the liquid droplet ejection device can be, other than an ink jet printer, a device for ejecting ink including electrode materials or materials such as coloring materials used to produce, for example, a liquid crystal display, an EL (electroluminescence) display, a surface emitting display, or a color filter in a dispersed or dissolved manner, a device for ejecting a bio organic substance for use in a bio chip production, a device for ejecting ink as a sample used as a precision pipette, a printing device or a micro dispenser. Furthermore, a device for ejecting lubricating oil to a precision machine such as a clock, a camera, etc., at a pin point, a device for forming, e.g., a small rounded lens (optical lens) for use as an optical communication element, a device for ejecting ultraviolet curable liquid and hardening it by light or heat, or a device for ejecting etching liquid such as acid, alkali, etc., to etch a substrate, etc., can be employed. The present invention can be applied to any one of liquid droplet ejection device among these devices.

In the aforementioned Examples, in order to prevent scuffing of fibers of the surface of a liquid absorber 200, a thin nonwoven fabric can be adhered to the surface. Since the nonwoven fabric to be adhered is thin as compared with the liquid absorber 200, the influence to the ink permeability or retaining performance is small.

In the aforementioned Examples, the concave portion 280 of the liquid absorber 200 is formed into a rectangular shape, but not limited to it. It can be, for example, a trapezoidal shape, or a triangular shape (saw-tooth shape). Further, it can be an arc-shape, an oval shape, or wave shape. Further, in a plan view, it can be a polygonal shape or a round shape. These can obtain the same effects as mentioned above.

Further, the concave portion can be arranged apart from the outer peripheral surface. For example, a through-hole can be formed at a position apart from the outer peripheral surface of the liquid absorber 200.

In the figures of the aforementioned embodiment, the low-density portion and the high-density portions are depicted so that their thicknesses look approximately the same. However, the thicknesses can be changed depending on ink. For example, if the ink is high in degree of viscosity and hard to permeate, it is preferable to increase the thickness of the low-density portion than the thickness of the high-density portion to enhance the permeability. On the other hand, if the ink is low in degree of viscosity and easily to permeate, it is preferable to decrease the thickness of the low-density portion than the thickness of the high-density portion.

Although the density was described in each Example and Comparative Example, these are samples. Further, the density is a numeral of the highest portion and low portion.

In the aforementioned embodiments, the pulp sheet includes a wood pulp of a needle-leaf tree, a broad-leaf tree, etc., non-wood plant fibers such as hemp, cotton, kenaf, etc., and a recycled paper.

In the aforementioned embodiments, cellulose fibers were used as fibers which constitute a main component, but it is not limited to cellulose fibers as long as it is a material which can absorb ink and differentiate the density. The fiber can be a fiber made from plastic such as polyurethane or polyethylene terephthalate (PET) or another fiber such as wool.

The method of forming the liquid absorber is not limited to the method recited in the aforementioned Examples. As long as the features of the present application can be exerted, another production method such as a wet type method can be employed.

As the fusion bondable resin, thermosetting resin can be used.

In forming the liquid absorber 200 or the sound absorber 400, it can be configured such that, after subjecting the accumulated deposit to a pressurizing and heating treatment, a resin layer is formed on the surface of the deposit and then heat cutting is performed. With this, the resin layer is introduced inside, and therefore occurrence of scuffing of fibers of the cut plane can be prevented.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid absorber that is constituted mainly by fibers, includes fusion bondable resin, and is configured to absorb liquid, comprising:

a first surface having a largest surface area, wherein the first surface consists of a single plane; and a second surface perpendicular to the first surface, the second surface including a surface low in degree of fusion bond of the fusion bondable resin and a surface high in degree of fusion bond of the fusion bondable resin that has a higher degree of fusion bond of the fusion bondable resin than the surface low in degree of fusion bond, a boundary between the surface low in degree of fusion bond and the surface high in degree of fusion bond extending perpendicular to the first surface, at least a part of the surface low in degree of fusion bond absorbing the liquid.

2. A liquid absorber that is constituted mainly by fibers, includes fusion bondable resin, and is configured to absorb liquid, comprising:

a first surface having a largest surface area;

a second surface perpendicular to the first surface, the second surface including a surface low in degree of fusion bond of the fusion bondable resin and a surface high in degree of fusion bond of the fusion bondable resin that has a higher degree of fusion bond of the fusion bondable resin than the surface low in degree of fusion bond;

at least a part of the surface low in degree of fusion bond absorbing the liquid; and a concave portion, wherein a surface of the concave portion is the surface low in degree of fusion bond.

3. The liquid absorber according to claim 2, wherein an outer peripheral surface of the liquid absorber is formed by the surface high in degree of fusion bond of the fusion bondable resin that the second surface includes, and the second surface includes the concave portion.

4. The liquid absorber according to claim 3, wherein the concave portion is formed by cutting a part of an outer periphery of the liquid absorber.

5. The liquid absorber according to claim 3, wherein the concave portion is positioned apart from the outer peripheral surface.

6. A liquid tank comprising:

the liquid absorber according to claim 1; and an accommodation portion configured to accommodate the liquid absorber.

7. A liquid droplet ejection device comprising:

a head configured to eject liquid; and the liquid tank according to claim 6, the liquid tank being configured to capture the liquid discharged from the head.

* * * * *